United States Patent [19]

Copithorne

[11] 4,335,479

[45] Jun. 22, 1982

[54] METHOD AND APPARATUS FOR MAKING BLIND RIVETS

[75] Inventor: Alton R. Copithorne, Rowley, Mass.

[73] Assignee: Celus Fasteners Manufacturing, Inc., Andover, Mass.

[21] Appl. No.: 168,299

[22] Filed: Jul. 14, 1980

Related U.S. Application Data

[63] Continuation of Ser. No. 908,722, May 23, 1978, abandoned.

[51] Int. Cl.[3] ..... B21K 1/60; B23P 11/00; B21D 39/00

[52] U.S. Cl. ..... 10/18; 10/27 R; 29/517; 29/788; 29/796

[58] Field of Search ..... 10/9, 27 E, 27 R, 155 R, 10/155 A, 169, 11 R, 18; 29/175, 517, 788, 796

[56] References Cited

U.S. PATENT DOCUMENTS

| | | | |
|---|---|---|---|
| 3,426,375 | 2/1969 | Jeal | 10/27 R |
| 3,438,301 | 4/1969 | Mattioli | 10/27 R X |
| 3,463,046 | 8/1969 | Welch et al. | 29/517 X |
| 3,786,527 | 1/1974 | Morton et al. | 10/169 |
| 3,956,918 | 5/1976 | Rao | 29/517 X |
| 4,067,224 | 1/1978 | Birks | 29/517 X |
| 4,149,287 | 4/1979 | Skierski | 10/9 |

*Primary Examiner*—Ervin M. Combs
*Attorney, Agent, or Firm*—Cesari and McKenna

[57] ABSTRACT

In the manufacture of a blind rivet, a threaded mandril is positioned endwise in a flanged, cylindrical, rivet body. The mandril-containing body is then advanced into a work station between a pair of spaced-apart, C-shaped die sections. The die sections are specially shaped so that when they are forcibly brought together with the rivet body between them, they first almost fully encircle and capture the body without physically appreciably deforming it. Then as the die sections bottom against one another, they coin the rivet body thereby staking the mandril in the body while simultaneously forming a pair of precisely sized, diametrically opposite ribs in the rivet body that extend part way along the length of the body intermediate its ends.

11 Claims, 11 Drawing Figures

METHOD AND APPARATUS FOR MAKING BLIND RIVETS

This is a continuation, of application Ser. No. 908,722 filed May 23, 1978, abandoned.

BACKGROUND OF THE INVENTION

This invention relates to the manufacture of blind rivets. It relates more particularly to a method and means for making blind rivets of the threaded-mandril type.

The blind rivets with which we are concerned here comprise a generally cylindrical flange body shaped more or less like a stove pipe hat. The top of the rivet body may be open or closed depending upon the particular application. Extending into the rivet body from its flanged end is an elongated stem or mandril. The internal end of the mandril is threaded and is staked in position by radially upsetting portions of the rivet body into engagement with the mandril threads while simultaneously forming, intermediate the upset portions, a plurality of circumaxially spaced, longitudinally extending external ribs on the body.

The rivet is installed by inserting the rivet ribbed-end-first through registering openings in the parts to be connected together. Then the rivet is set using a tool which retracts the exposed end of the mandril while reacting against the flanged end of the rivet body thereby causing lengthwise contraction and radial enlargement of the rivet body between its ribbed end and the adjacent part. The enlargement reaches a sufficient size to retain the rivet body in the openings prior to the forceful disengagement of the mandril from the rivet body.

In the conventional manufacture of blind rivets of this type, fully described in U.S. Pat. No. 3,463,046, the threaded end of the mandril is inserted into the rivet body. The rivet body containing the mandril is then thrust closed end first between the relaxed jaws of a three-jaw split collet. The collet is then closed on the inner end portion of the rivet body to crimp it. The collet jaws are provided with arcuate circumaxially space, rivet-engaging inner faces which reshape the rivet body by forming circumaxially spaced, longitudinally extending deformations at the inner end of the body which are pressed into the mandril threads. These deformations are separated by circumaxially spaced, longitudinally extending ribs.

The assembly of rivets using the split collet arrangement results in extrusion of the rivet ribs into the gaps between the collet jaws so that the ribs project radially outward appreciably beyond the remainder of the rivet body. Consequently, in order to properly size the ribs as to their radial extent so that the rivet will fit in a standard size hole for that size rivet, a slidable pin must be provided which projects into the collet and pushes the entire rivet assembly back through a sizing die thereby forcing excess rib material back on itself so that the ribs no longer extend beyond the remainder of the rivet body. Thus the fabrication of each rivet requires not only a crimping operation but also a subsequent sizing operation.

The assembly of these rivets is slow also because the mandril-containing rivet body must be inserted into and ejected from the three-jaw collet and sizing die along the axis of the collet and die. Consequently, each crimped rivet assembly must be completely ejected from the collet and die before the insertion of the next rivet body-mandril pair can commence.

Consequently, the conventional apparatus for making these rivets is relatively complex and expensive. Moreover, being a two-step machine, it has a relatively low rivet production rate and a correspondingly high per unit cost.

SUMMARY OF THE INVENTION

Accordingly the present invention aims to provide apparatus for making blind rivets of the threaded-mandril type efficiently and reliably.

Another object of the invention is to provide apparatus for making rivets of this type which is particularly adapted to the high volume production line manufacture of such rivets.

Yet another object of the invention is to provide apparatus for making open or closed end blind rivets whose bodies can be fabricated out of different metals including aluminum, steel, titanium, brass, magnesium, etc.

Another object of the invention is to provide apparatus for making rivets of this type whose bodies are secured to their mandrils and whose body ribs are formed to the correct size all in a single operation.

Still another object of the invention is to provide a method of making blind rivets of the threaded-mandril type that produces one or more of the aforesaid advantages.

A further object is to provide method and means for making such rivets having oversized rigidifying ribs in a controlled fashion.

Other objects will, in part, be obvious and will, in part, appear hereinafter.

The invention accordingly comprises the several steps and the relation of one or more of such steps with respect to each of the others and the apparatus embodying the features of construction, combination of elements and arrangement of parts which are adapted to affect such steps, all as exemplified in the following detailed description, and the scope of the invention will be indicated in the claims.

Briefly, in accordance with the present rivet forming technique, a succession of conventional blind rivet bodies drawn from a hopper are deposited flanged end up in the slots of an index wheel. Also a succession of threaded mandrils drawn from a second hopper are deposited in stations around a second index wheel that overlaps the first wheel. At the wheels are indexed, successive locations of the second index wheel are superimposed on successive locations of the first index wheel so that a mandril is deposited, threaded end first, into a rivet body carried by the first indexing wheel. Continued indexing of the wheels thus advances a succession of partially assembled mandril-containing rivet bodies laterally into a work station where the assembly operation is completed.

The work station contains a die composed of two sections which are disposed radially with respect to the first index wheel. One die section is stationary, while the other die section is movable by means of a piston or the like between an open position in which it is spaced from the stationary section to a closed position in which it engages and bottoms against the stationary section. The die is positioned relative to the first index wheel so that when it is open, the partially assembled rivets can be indexed, in turn, between the two sections.

Upon the arrival of each partially assembled rivet at the work station, the piston is actuated thereby forcibly moving the movable die section toward the stationary die section so that they coin opposite sides of the rivet body. Immediately thereafter the die opens and the completed rivet is advanced out of the work station as the next partially assembled rivet is advanced into that station. Thus the rivets can be assembled on a continuous, high volume basis.

The die located at the work station is specially shaped so that when its two sections are forced together, they first almost encircle and capture the mandril-containing rivet body. Then the two sections in bottoming against one another, physically deform the body by means of a coining process thereby staking the mandril in the body while simultaneously erecting a pair of diametrically opposite ribs extending along the rivet body intermediate its ends. Since the die sections substantially encircle the rivet body during the coining operation, the diametric span of the ribs is precisely sized as is the diameter of the undeformed remainder of the rivet body. Also there are no metal flashes on the edges of the ribs as is the case with rivets made by the usual methods. Consequently, rivets made in accordance with the present technique can be manufactured on a very reliable basis with precise dimensions in the radial direction so they will properly fit the standard size opening for that particular size rivet.

In actual practice, the diametric span of the ribs may be made somewhat or appreciably larger than the diameter of the undeformed remainder of the rivet body so that the ribs snugly fit, or can be forced into, the standard opening for that size rivet which is invariably larger than the standard diameter of the undeformed rivet body. In that way, one person can insert the rivets into their holes and they will remain wedged in place until another person sets them with a rivet setting tool. Any tendency for portions of the rivet to assume larger diameters is diverted or displaced by the coining process into, at most, a slight elongation of the rivet body which does not effect the ability of the rivet to fit in the industry set standard size opening.

The assembly of the rivet using a capture and coining process also permits these rivets to have bodies made of a wide variety of different metals including magnesium, brass, stainless steel, titanium, aluminum, etc. which have entirely different metallurgical characteristics in terms of their ductility, hardness, mass, etc. Moreover, since the coining process is carried out intermediate the ends of the rivet body rather than at the end wall thereof as has been done heretofore, a minimum amount of force is required to assemble the rivet. Thus the assembly apparatus concentrates its energy from the piston at the die in the work station so that a minimum amount of power is required to properly coin the rivet body to complete the rivet. Therefore the apparatus can comprise a relatively small piston and other unmassive ancillary mechanical parts arranged in a compact package which can be retrofit on existing open end rivet making machines to achieve sufficiently high production rates to make possible the economical manufacture of closed end blind rivets.

Yet with all of these advantages, the cost of the present apparatus is no more than that of the prior equipment for assembling rivets of the threaded mandril type.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENT

Figure 6A:
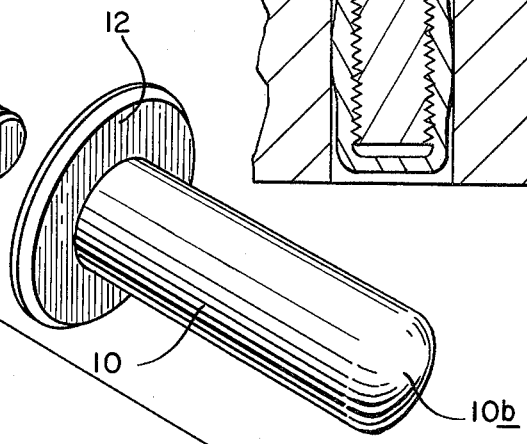
FIGS. 6A and 6B are perspective views of the rivet components before and after assembly.

Referring first to FIG. 6 of the drawings, rivets made in accordance with this invention comprise a generally cylindrical hollow rivet body 10. One end 10*e* of the rivet body is open and a flange 12 encircles the open end. The other end 10*b* of the rivet body may be either open or closed. In the illustrated example, it is closed so that the rivet can effect a fluid-tight connection between two work pieces. The rivet body 10 can be fabricated of steel, aluminum, stainless steel, titanium, magnesium or other such metals depending upon the particular application.

The present rivet also includes a stem or mandril 14. At least one end of the mandril is threaded at 14*a* and the stem is dimensioned to snugly fit in the rivet body 10. Preferably for ease of automated assembly, both ends of the mandril are threaded as illustrated so that either end may be inserted into the rivet body.

Figure 6B:
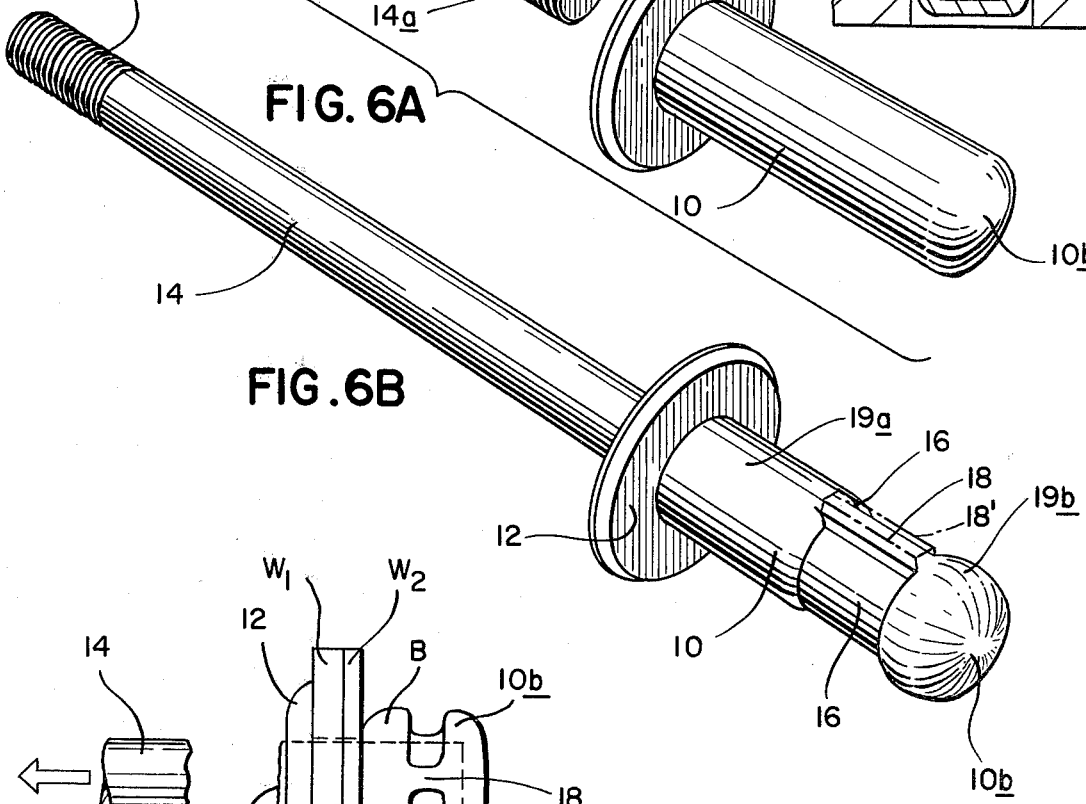

The rivet components, after they are completely assembled as will be described presently, are depicted in FIG. 6B. As seen there, the rivet body 10 has a pair of diametrically opposite depressions 16 near its closed end 10*b*. Some metal in the areas of depressions 16 has been moved by a coining process into the spaces between the threads on the mandril end 14*a* inside the body thereby staking or anchoring the mandril in the body. Other metal in those depressions has been moved circumferentially to erect a pair of diametrically opposite lengthwise ribs 18 (only one of which is shown) that separate the two depressions 16. These ribs 18 stiffen the rivet body in that region so that it resists lengthwise contraction when the rivet is set. Between flange 12 and ribs 18 is a relatively long cylindrical undeformed body portion 19*a* and between the ribs and the body end 10*b* is a second shorter cylindrical undeformed body portion 19*b*. The diametric span of the ribs 18 may be somewhat larger than that of the undeformed portions 19*a*, 19*b* of the rivet body 10, as shown, with the span being precisely controlled during the coining process so that the ribs snugly fit into the standard opening for the particular size rivet. Alternatively, the ribs can extend appreciably beyond body portions 19*a* and 19*b* as will be described later.

Figure 7:
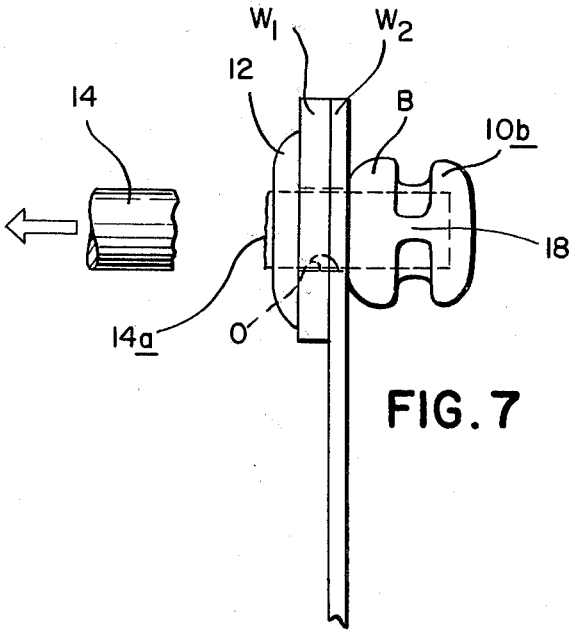
FIG. 7 is an elevational view showing the rivet components after the rivet is set in a pair of superimposed plate openings.

Referring for a moment to FIG. 7, the rivet is installed by inserting it closed-end-first into registering openings O in the work pieces W1 and W2 that are to be secured together until the flange 12 is flush against the adjacent work piece. The fact that its end portion 19*b* is smaller in diameter than the span of ribs 28 facilitates locating the rivet in the openings. Then using a conventional blind rivet setting tool, the mandril 14 is retracted from the rivet body with the tool reacting against the rivet flange 12. Since the threaded mandril end 14*a* is staked in the rivet body at the areas of depressions 16, with the ribs 18 stiffening the body in that region, the retraction of the mandril causes a radially outward bulging of the rivet body at B in the undeformed region between the ribs 18 and the adjacent work piece W2 as shown in FIG. 7. Ultimately bulge B bears against the work piece W2 thereby firmly clamping the work pieces W1 and W2 between the rivet flange 12 and the bulge and completely covering opening O. Continued retraction of the mandril may result in its threaded end 14*a* stripping the ribs or threads 21 formed inside the rivet body during the coining process which staked the mandril in the body so that the mandril pulls completely out of the rivet body. Alternatively, the mandril can be unscrewed from the body after the rivet is set. Most preferably, however, the mandril is scored or otherwise constructed so that it breaks invariably at the inner end of the threaded portion after the rivet is set so that the threaded end 14*a* is flush with flange 12 and fills the collapsed rivet body as seen in FIG. 7. The mandril portion 14*a* thus serves to lend considerable shear strength to the set rivet.

Figure 1:
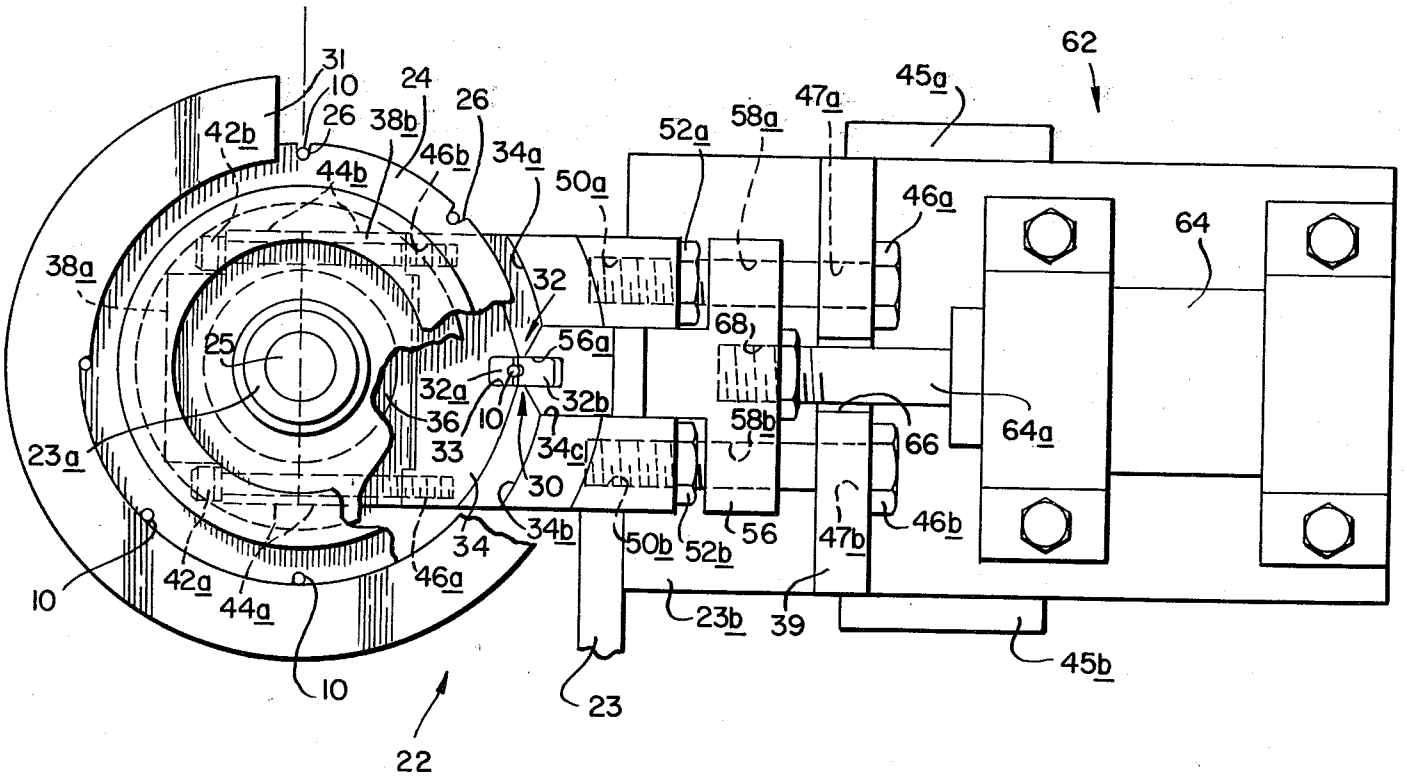
FIG. 1 is a top plan view with parts broken away of a rivet assembly apparatus embodying the principles of this invention.
Figure 2:
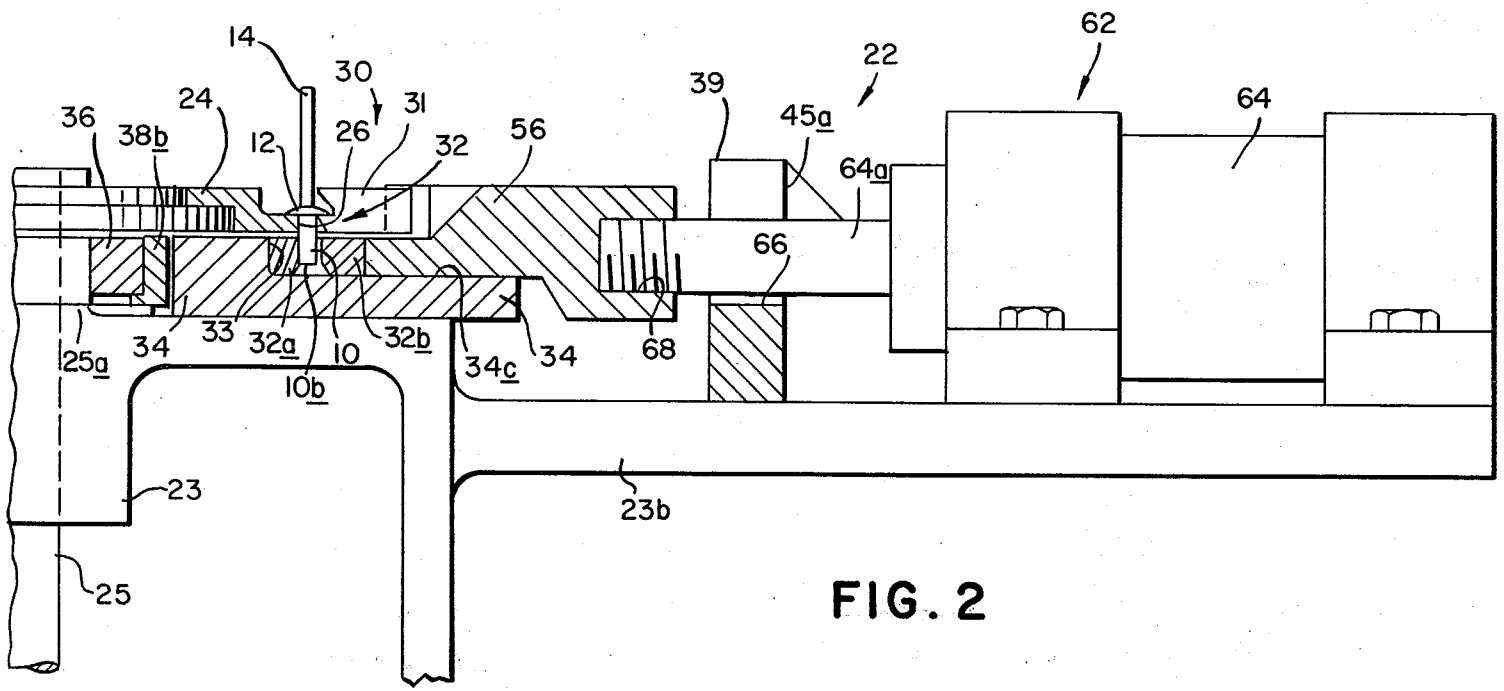
FIG. 2 is a side elevational view with parts in section of the FIG. 1 apparatus on a slightly larger scale.

Turning now to FIGS. 1 and 2 of the drawings, the mandril and rivet body are assembled by means of the apparatus indicated generally at 22. This apparatus includes a base or table 23 which supports a first rotary index wheel 24 by way of a shaft 25 journaled in a necked-down flange 25*a* in the base. The index wheel contains a series of slots 26 spaced around its rim. Each slot is sized to receive a rivet body 10, the rivet body being supported by its flange 12 which bears against the top of the index wheel.

The rivet bodies drawn from a hopper (not shown) are deposited in the slots 26. A second index wheel (not shown) rotating in synchronism with the first wheel is loaded with mandrils 14, also drawn from a suitable supply hopper (not shown). The second index wheel overlaps the first wheel and the two are arranged so that as they index, a mandril carried by the second wheel is dropped endwise into a rivet body carried by the first index wheel. Thus continued indexing of the wheels advances a succession of mandril-containing rivet bodies towards a work station indicated generally at 30.

A stationary ring section 31 whose inside diameter is only slightly larger than that of wheel 26 is positioned concentric with the wheel so as to retain the rivet bodies in the slots 26 between the point where the rivet bodies are deposited on the index wheel until a point beyond the work station 30 where the fully assembled rivets drop or are ejected from the wheel.

The work station 30 contains a special die 32 to be described in detail later. Die 32 comprises two sections, namely, a stationary section 32*a* and a movable section 32*b*. The stationary die section 32*a* is mounted in a notch 33 in a generally rectangular block 34 positioned on base 23. Block 34 is clamped to the base flange 23*a*. More particularly, a ring 36 is engaged over the flange 23*a*. Also a pair of mating clamp sections 38*a* and 38*b* having semi-cylindrical opposing faces with the same diameter as the outside diameter of ring 36 are engaged on opposite sides of the ring. These sections are drawn together by bolts 42*a* and 42*b* that extend through registering passages 44*a* and 44*b* at each side of the two clamp sections and are turned down into threaded passages 46*a* and 46*b* at each side of block 34.

The opposite end of block 34 is anchored to a wall 39 secured to a lateral extension 23*b* of base 23 which, in turn, is reinforced by a pair of struts 45*a* and 45*b* extending between the ends of wall 39 and the side edges of extension 23*b*. The connection between the block 34 and the wall is provided by a pair of bolts 46*a* and 46*b* which extend through passages 47*a* and 47*b* in wall 39 and are turned down into threaded openings 50*a* and 50*b* in the end of block 34. Stop nuts 52*a* and 52*b* are provided on the bolts adjacent the end of block 34 to lock block 34 and bolts 46*a*, 46*b* in their relative positions.

The block 34 is formed with a pair of arcuate channels 34*a* and 34*b* at each side of the stationary die section 32*a*. These channels accommodate the portions of the rivet bodies that extend below the work table 26 as the bodies are advanced toward and away from the work station 30. These channels are deep enough to provide appreciable clearance for the closed end 10*b* of the rivet body as shown in FIG. 2.

Block 34 also has a relatively wide lengthwise channel 34*c* that extends in from its right hand end and intersects the arcuate channels 34*a* and 34*b*. This channel 34*c* provides clearance for a movable T-shaped slider 56. The slider 56 is notched at 56*a* to accommodate the movable die section 32*b*. Passages 58*a* and 58*b* are provided in the arms of the slider which slidably receive the bolts 46*a* and 46*b* which function as guides so that the slider can be moved from a retracted position in which the die section 32*b* is retracted from channels 34*a*, 34*b* to an extended position in which that die section bottoms against the die section 32*a*.

The slider 56 and die section 32*b* are moved between these two positions by a double acting hydraulic piston shown generally at 62. The piston comprises a cylinder 64 that is anchored to the end of base extension 23*b* extending beyond wall 39. Projecting from the cylinder is a piston rod 64*a* that extends loosely through a central opening 66 in wall 39 and is threaded into a passage 68 in the right hand end of slider 56.

During operation of the apparatus, each time the index wheel 24 is indexed counterclockwise to bring a mandril-containing rivet body into the work station 30, the piston 62 is actuated to momentarily move the slider 56 to its extended position to form the finished rivet at the work station. Thereupon the piston 62 retracts the slider so that the index wheel 24 is free to index the completed rivet out of the work station 30, via channel 34*a* while at the same time advancing a new mandril-rivet body pair into that station along channel 34*b*. The completed rivets leaving the work station 30 simply fall or are ejected from their slots 26 in the wheel 24 and can be accumulated in a hopper or conveyed to other machinery which counts and packages them.

It will be appreciated that this mode of moving each rivet relative to the work station along a direction perpendicular to the axis of the rivet permits rivet components to be advanced into and out of the work station simultaneously. Consequently the production rate of the apparatus is much higher than that of prior machines for producing blind rivets of this type. Actually the present apparatus can operate continuously for prolonged periods essentially unattended except for periodic inspection and refilling of the rivet body and mandril hoppers to maintain an adequate supply of components to feed the machine.

Figure 3:
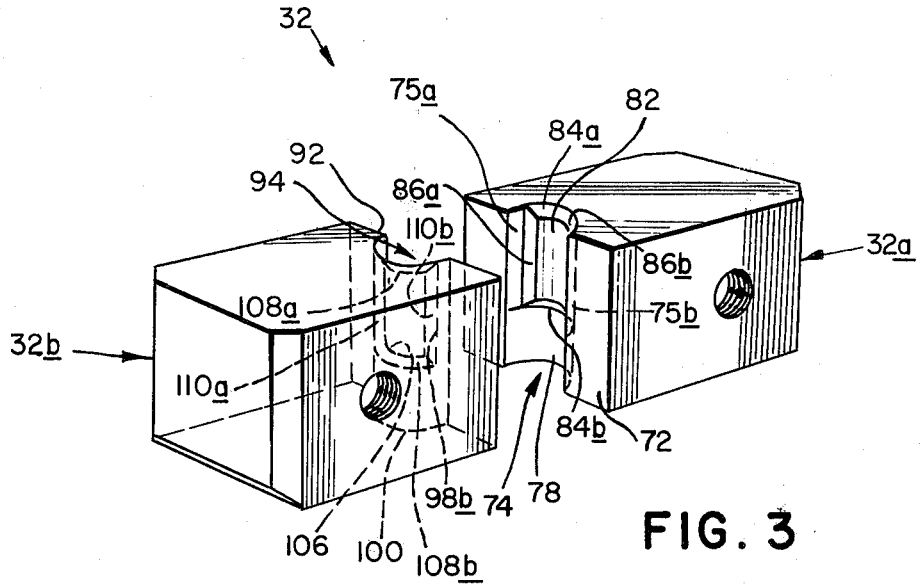
FIG. 3 is a perspective view on a much enlarged scale of a split die incorporated into the FIG. 1 apparatus.
Figure 4A:
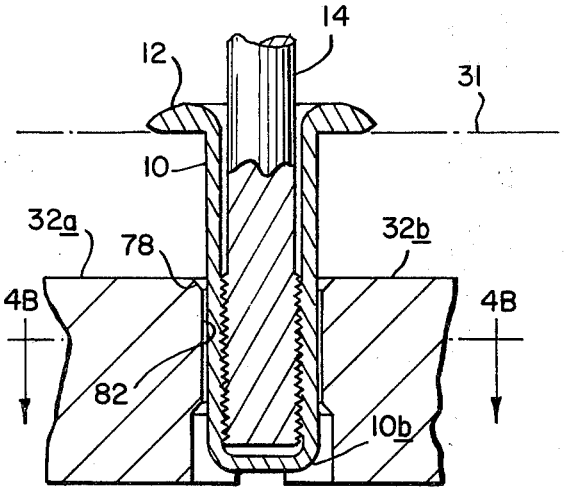
FIGS. 4A and 4B are longitudinal and transverse sectional views respectively of rivet assembly components captured by the partial closure of the FIG. 3 die.
Figure 4B:
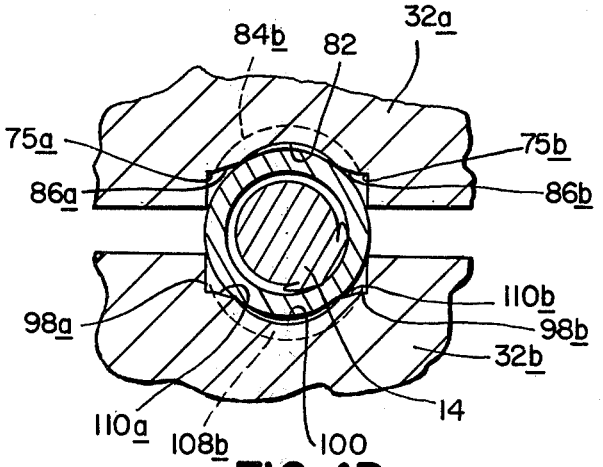

Referring now to FIGS. 3 and 4B, the die sections 32*a* and 32*b* comprising die 32 are mirror images of one another. The front wall 72 of section 32*a* is formed with a centrally located vertical slot 74 which extends the full height of the die section. The width of the slot corresponds to and determines the total span of ribs 18 (FIG. 6B). The bottom wall of slot 74 has a pair of narrow coplanar flat vertical surfaces 75*a* and 75*b* at opposite sides of the slot. In between those surfaces is a vertical semi-cylindrical section 78 which extends from the bottom of die section 32*a* a little more than one-third of the way toward its top. The radius of this portion 78 corresponds to the radius of the outside wall of the undeformed rivet body portion 19*b* (FIG. 6B).

Directly above portion 78 is a second semi-cylindrical portion 82 whose radius is smaller than that of portion 78 corresponding instead to the radius of the outside surfaces of the depressed areas 16 in the finished rivet depicted in FIG. 6B. The lower edge of portion 82 is beveled at 84*a* at an angle of approximately 45°. Similarly the upper edge of portion 82 has a 45° bevel at 84*b*. The side edges of portion 82 where they join the flat surfaces 75*a* and 75*b* are also beveled at 86*a* and 86*b* with the bevel angle being approximately 15°.

Still referring to FIGS. 3 and 4B, the front face 92 of the die section 32*b* is formed with a relatively deep, centrally located, vertical slot 94 which extends the entire height of that die section. Slot 94 has the same width as slot 74 and is positioned directly opposite that slot. The bottom wall of slot 94 is formed with a pair of coplanar, narrow, flat, vertical surfaces 98*a* and 98*b* adjacent the side walls of the slot. Between those surfaces is a vertical, semi-cylindrical portion 100 which extends from the bottom of the die section a little more than a third of the way towards the top of that section. As such, it is coextensive vertically with slot portion 78 in die section 32*a*. The radius of portion 100 also corresponds to the radius of the outside wall of the rivet body portion 19*b* (FIG. 6B).

Directly above portion 100 is a second semi-cylindrical portion 106 that has the same radius as the outside walls of the depressed areas 16 in the finished rivet and is also coextensive with the slot portion 82 in die section 32*a*. Like portion 82, portion 106 has lower and upper edges 108*a* and 108*b* which are beveled at a 45° angle and side edges 110*a* and 110*b* which are beveled at an angle of approximately 15°. When the movable die section 32*b* is advanced or bottoms against section 32*a*, these beveled surfaces lie directly opposite one another.

Figure 5A:
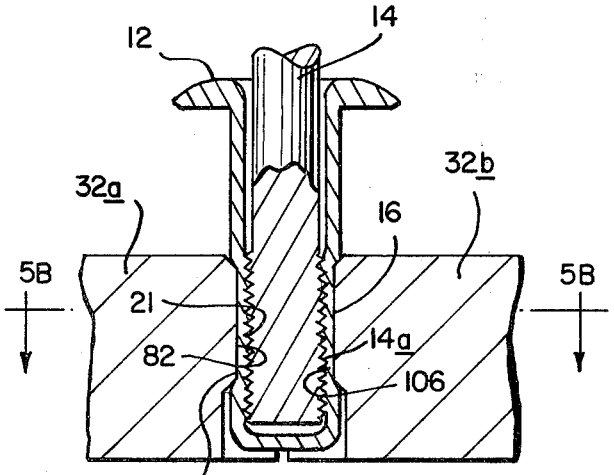
FIGS. 5A to 5C are similar views of the rivet assembly components when the die is fully closed.
Figure 5B:
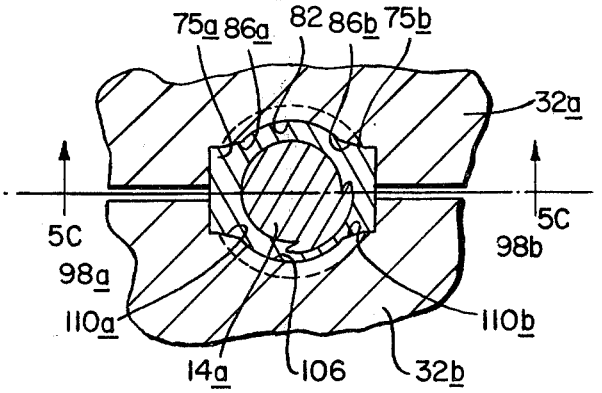
Figure 5C:
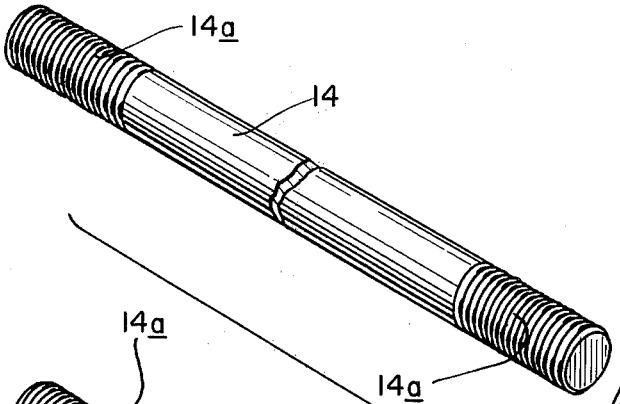
Figure 5C:
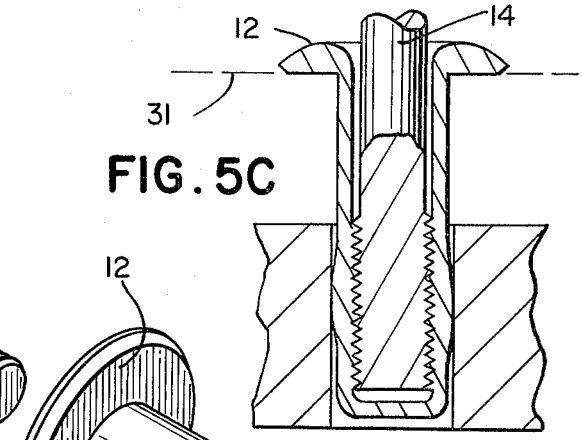

Referring now to FIGS. 4A and 4B, when a mandril-containing rivet body 10 is advanced into work station 30 it is positioned directly opposite the slot portions 78 and 82. Immediately thereafter the movable die section 32*b* is advanced towards section 32*a* by piston 62. As section 32*b* approaches section 32*a*, the walls of slots 74 and 94 engage around the rivet body prior to any appreciable deformation of the rivet body by the reduced radius die portions 82 and 106. However, these walls engage the rivet body sufficiently to capture and center it in the die. Thus at this point, the rivet is essentially almost encircled by the die. Upon further movement of the die section 32*b* towards section 32*a*, the reduced radius die slot portions 82 and 106 press against the opposing portions of the rivet body and, by a coining process, upset the metal therein into the mandril threads 14*a* between those portions thereby firmly staking or anchoring the mandril in the rivet body at those locations, as best seen in FIGS. 5A and 5C.

At the same time, the coining process shifts rivet body material from the areas of the depressions 16, thereby erecting the diametrically opposite ribs 18. Since the two die sections almost completely encircle the rivet body while deforming it, the formation of ribs 18 does not involve uncontrolled extrusion of rivet body material between the two die sections as is the case with prior comparable apparatus for making blind rivets of this general type. Rather, the side walls of slots 74 and 94 and the flat die surfaces 98*a* and 98*b* together with the beveled surfaces 110*a* and 110*b* in die section 32*b* cooperate with the corresponding flat surfaces 75*a* and 75*b* and beveled surfaces 86*a* and 86*b* of die section 32*a* to coin the rivet body so that the shape, length and total diametric span of the ribs 18 are precisely controlled.

Accordingly, the capture-coining sequence employed by the present apparatus ensures that the finished rivet has precisely controlled cross-sectional dimensions so that the rivets made by the present apparatus have a relatively low rejection rate. Such deformation of the rivet body that does occur in the ostensibly undeformed portions 19*a* and 19*b* thereof are limited to slight elongations of those portions which do not effect the ability of the rivet to fit properly in the standard opening for that size rivet. Also, it should be noted at this point that, as best seen in FIGS. 5A and 5C, sufficient clearance is left below the rivet body end 10*b* at the work station 30 to accommodate any elongation of the rivet body caused by the aforesaid coining process. Further, it should be emphasized that the coining of the rivet body at locations displaced from its end 10*b* means that the process can be carried out with a minimum amount of force. In other words, the lateral end wall of the rivet body that spans the side wall thereof tends to reinforce the rivet body at that location making it more difficult to deform the body. The present apparatus which coins the body at locations removed from the end wall can, therefore, be composed of smaller and more compact and less massive components than prior comparable machines which crimp the end wall. Likewise, a smaller hydraulic system can be used. Resultantly, being comprised of relatively small components, the present apparatus can be retrofit on conventional machines for making open-ended blind fasteners and eyelets.

It will thus be seen that the objects set forth above, among those made apparent from the preceding description, are efficiently attained. Also certain changes may be made in carrying out the above method and in the construction set forth without departing from the scope of the invention. For example, the die 32 can be dimensioned so that the rivet ribs 18 extend appreciably beyond the remainder of the rivet body as shown in dotted lines at 18' in FIG. 6B. In this event, the total lateral span of the ribs would exceed the direction of the standard opening for that particular diameter rivet body. This would require drilling a larger than standard opening for that size rivet. However, we have found that the filling properties of the present rivet, i.e., the size of bulge B (FIG. 7), are unusually good so that bulge B is quite able to fill and cover the oversized hole.

Therefore, it is intended that all matter contained in the above description or shown in the accompanying drawings shall be interpreted as illustrative and not in a limiting sense.

It is also to be understood that the following claims are intended to cover all of the generic and specific features of the invention herein described.

I claim:

1. The method of making blind fasteners each having a flanged hollow body and a threaded mandril projecting from the body, said method comprising the steps of A. positioning the threaded ends of a succession of mandrils in a corresponding succession of bodies, B. automatically and continuously advancing the mandril-containing bodies in succession along a continuous track, having a direction of movement which is generally perpendicular to the longitudinal axes of the mandrils into the gap betwen no more than two spaced-apart die sections, the die sections being dimensioned so as to deform the body to have at most a preselected maximum diameter, and C. moving the two die sections relatively toward one another along a direction substantially perpendicular to the axes of the mandrils and also perpendicular to the track when each body is in the gap so as to capture each body between them and to upset body material by means of a coining process into the threads of the associated mandril thereby staking the mandril in the body while simultaneously erecting a pair of stiffening ribs that project radially from the body at locations spaced from the body flange.

2. The method defined in claim 1 and including the additional step of almost completely encircling the rivet body prior to any appreciable deformation of the body by the die sections during the moving step so as to prevent premature extrusion of body material between the sections as the two sections are moved relatively together.

3. The method defined in claim 1 wherein the two die sections engage the rivet body at locations spaced from both ends of the body.

4. The method defined in claim 1 wherein the ribs are formed on diametrically opposite sides of each body.

5. The method defined in claim 4 and including the additional step of forming the ribs with a total span that is larger than the diameter of the remainder of the rivet body.

6. Apparatus for making blind fasteners of the type composed of a flanged, hollow rivet body and a threaded mandril projecting from the body, said apparatus comprising A. a base defining a work station, B. means for advancing mandril-containing rivet bodies successively through the work station along a direction perpendicular to the longitudinal axes of the mandrils, C. a pair of opposed mating die sections supported by the base at the work station, at least one of said die sections being movable along a direction generally perpendicular to the longitudinal axes of the mandrils, and D. means for moving the die sections toward one another relatively when a mandril-containing rivet body is located at the work station so as to capture that body between the two die sections and to upset body material by means of a coining process into the threads of the associated mandril thereby staking the mandril in the body, while simultaneously erecting a pair of stiffening ribs that project radially from the body at locations spaced from the body flange.

7. The apparatus defined in claim 6 wherein

A. the heights of the die section parts deforming each body are less than that of each body, and B. the two sections capture each body at locations spaced from the ends of each body.

8. The apparatus defined in claim 6 wherein each die section has a slot, the bottom wall of the slot being formed with lengthwise contiguous semicylindrical slot portions, one of said slot portions having a diameter approximately equal to that of the fastener body, the other of said portions having a diameter less than that of the first portion, the slots in the first and second die sections being shaped so that when the two die sections are moved together with a fastener body between them, the wall of the slots substantially encircle the body before the two sections deform the body to any great extent.

9. The apparatus defined in claim 6 wherein

A. one of the die sections is stationary, and

B. the means for moving the other die section comprises a hydraulic system acting between the second section and the base.

10. The apparatus defined in claim 6 wherein the die sections are shaped to form the ribs on diametrically opposite sides of each body.

11. The apparatus defined in claim 10 wherein the die sections are shaped to form the ribs with a total span which is larger than the diameter of the remainder of the rivet body.

* * * * *